United States Patent [19]

Knighton et al.

[11] Patent Number: 4,664,205

[45] Date of Patent: May 12, 1987

[54] HYDRAULIC INNER BARREL IN A DRILL STRING CORING TOOL

[75] Inventors: Kelly Knighton, West Jordan; J. Stanley Davis, Sandy; Steven R. Radford, West Jordan, all of Utah

[73] Assignee: Norton Christensen, Inc., Salt Lake City, Utah

[21] Appl. No.: 721,993

[22] Filed: Apr. 11, 1985

[51] Int. Cl.[4] ..... E21B 10/02

[52] U.S. Cl. ..... 175/58; 175/235; 175/250; 175/253

[58] Field of Search ..... 175/58, 232, 234, 235, 175/250, 253, 321

[56] References Cited

U.S. PATENT DOCUMENTS

| | | | |
|---|---|---|---|
| 1,867,720 | 7/1932 | Wellensick | 175/234 |
| 2,019,176 | 10/1935 | Dodds | 175/253 |
| 2,747,841 | 5/1956 | Adamson et al. | 175/250 |
| 2,893,691 | 7/1959 | Johnson | 175/250 |
| 4,356,872 | 11/1982 | Hyland | 175/58 |
| 4,552,229 | 11/1985 | Radford et al. | 175/253 |
| 4,553,613 | 11/1985 | Radford | 125/250 |

*Primary Examiner*—Stephen J. Novosad
*Assistant Examiner*—William P. Neuder
*Attorney, Agent, or Firm*—Beehler, Pavitt, Siegemund, Jagger, Martella & Dawes

[57] ABSTRACT

An axial bore is defined throughout the hydraulic lift inner barrel. This axial bore is communicated with the interior of the inner tube thereby allowing the interior of the inner tube to be flushed prior to initiation of the coring operation. When the coring operation is begun, flow of drilling fluid to the interior of the inner tube is prevented by allowing a ball dropped within the drill string to seat within a plug through which the communicating axial bore is defined. Once the flow of drilling fluid to the interior of the inner tube is stopped, the coring operation can begin. After the coring operation is completed, a second ball is dropped and allowed to seat within an inner mandrel through which the axial bore of the coring tool is also defined. Once the axial bore of the inner mandrel is closed, drilling fluid is forced into an expansion chamber within a telescopic piston disposed circumferentially outside of the inner mandrel. The piston is connected to the inner tube. Diversion of drilling fluid into the expansion chamber causes the piston to be longitudinally displaced upward with respect to the inner mandrel, and hence with respect to the outer tube of the drill string. The inner tube is thus similarly lifted within the drill string, thereby activating core catchers or any other downhole mechanism coupled directly or indirectly to the inner tube.

19 Claims, 3 Drawing Figures

HYDRAULIC INNER BARREL IN A DRILL STRING CORING TOOL

BACKGROUND OF THE INVENTION

1. Field of the Invention

The present invention relates to the field of earth boring tools, and in particular to the operation and apparatus relating to downhole tool operation such as core catchers.

2. Description of the Prior Art

Coring is in common practice in the field of petroleum exploration and it involves a practice wherein a drill string, comprised of sections of outer tube, which ultimately terminate in a coring bit, cut a cylindrically shaped core segment from the rock formation. The core is then broken off and brought to the surface for examination. However, it is not uncommon to encounter formations which are unconsolidated, fragmented or loose. Therefore the core, after being cut, generally will not retain a rigid configuration but must be held and retained within an inner tube which is concentrically disposed within the outer tube of the drill string. Furthermore, not only must a core catcher be activated to break the lower portion of the core from the underlying rock formation from which it was cut, but in many cases the rock formation is so unconsolidated, as in the case of oil-sand, water-sand, or loose debris, that a full closure core catcher must be used to positively seal the bottom of the inner tube if the core material is to be retained within the inner tube as the drill string is lifted from the borehole. The best form of such full closure catchers are manipulatively operated from the surface at the end of the coring operation and prior to retrieval of the core sample. It thus becomes desirable to have some type of means within the drill string for performing these and other operations which may become necessary during coring operations, or generally within drilling operations.

Therefore, what is needed is an apparatus for manipulating the core catcher within a drill string, such as by lifting the inner tube to uncover the core catcher, to retain the cored material during coring operations. The apparatus must be rugged, simple in operation, reliable within the drilling environment and, preferably, automatically perform its operation once selectively initiated by the platform operator without dependence on gravity, friction with the core or any other aspect of the downhole operation being implemented.

BRIEF SUMMARY OF THE INVENTION

The present invention is an apparatus for hydraulically lifting an inner tube which is concentrically disposed within an outer tube of a drill string. A first mechanism diverts the hydraulic fluid within the outer tube. A second mechanism provides longitudinal displacement of the inner tube in response to selective diversion of the hydraulic fluid. The first mechanism selectively diverts hydraulic fluid to the second mechanism. The second mechanism is coupled to the inner tube. The second mechanism longitudinally displaces the inner tube in response to the hydraulic fluid diverted thereto by the first mechanism. A third mechanism selectively locks the second mechanism in a fixed position with respect to the outer tube. The third mechanism is also selectively provided with hydraulic fluid by the first mechanism. The third mechanism unlocks the second mechanism after a first predetermined magnitude of hydraulic pressure of the fluid has been supplied to the second and third mechanisms. The second mechanism then longitudinally displaces the inner tube with respect to the outer tube by a predetermined distance. The first mechanism then selectively rediverts the hydraulic fluid away from the second and third mechanisms when a predetermined distance of travel of the second mechanism is achieved. A fourth mechanism selectively provides hydraulic fluid to the inner tube prior to the commencement of activation of the first, second and third mechanisms, and selectively diverts hydraulic fluid from the interior of the inner tube prior to the activation of the first, second and third mechanisms.

By reason of this combination of elements, the inner and outer tubes are selectively longitudinally displaced with respect to each other in an automatic fashion by activation of the first mechanism, and the inner tube is selectively flushed by the hydraulic fluid prior to activation of the first mechanism.

More concretely, the invention includes a hydraulic lift apparatus for use in combination with a drill string in a coring tool. The drill string is characterized by including an outer tube connected to a coring bit, and having pressurized hydraulic fluid forced through the outer tube. The drill string is further characterized by an inner tube for receiving and lifting the core which is cut by the core bit. The hydraulic fluid generally flows between the inner and outer tubes to the core bit. The hydraulic lift apparatus comprises an inner mandrel longitudinally fixed and coupled to the outer tube and concentrically disposed within the outer tube. The inner mandrel defines an axial bore which is in communication with the interior of the drill string, and has hydraulic fluid supplied therethrough. An outer piston is disposed within the outer tube and is concentrically disposed in telescopic relationship about the inner mandrel. The outer piston is selectively longitudinally fixed wtih respect to the inner mandrel, and hence the outer tube. The outer piston is connected to the inner tube. The outer piston defines an expansion chamber in communication with the axial bore defined within the inner mandrel. A mechanism is included for providing hydraulic fluid and pressure to the expansion chamber of the outer piston, and for selectively locking the outer piston with respect to the inner mandrel. The outer piston is thereby selectively longitudinally displaced with respect to the inner mandrel, and thence the inner tube is lifted. An additional mechanism is included for providing hydraulic fluid to the interior of the inner tube before the coring begins. This mechanism communicates with the axial bore of the inner mandrel so that hydraulic fluid flowing therethrough is selectively communicated to the interior of the inner tube.

More specifically, the invention is an improvement in a hydraulic lift apparatus in a coring tool. The coring tool includes an outer tube and an inner tube for receiving a core cut by the coring tool. Hydraulic fluid is supplied under pressure to the interior of the coring tool. The improvement comprises an axial bore defined through the coring tool and communicating with the interior of the inner tube. A mechanism which communicates with the axial bore selectively prevents the communication of the hydraulic fluid with the inner tube, and selectively diverts the hydraulic fluid to an annular space defined between the outside of the inner tube and the inside of the outer tube. Another mechanism is provided for selectively drawing the inner tube longitudinally upward within the coring tool. By reason of this combination of elements, the coring tool may be used to flush the interior of the inner tube prior to initiation of a coring operation, and thereafter provide a positive actuating, longitudinally upward force at a selected time during the coring operation.

Finally, the present invention includes a method of providing hydraulic fluid flow through a coring tool. The method comprises the steps of providing a flow of hydraulic fluid under pressure from the interior of an outer tube within a drill string. The flow is provided longitudinally downward through an axial bore defined within the coring tool into the interior of the inner tube. Flow of the hydraulic fluid into the interior of the inner tube is then selectively interrupted. Hydraulic fluid is then diverted into an annular space defined between the outside of the inner tube and the inside of the outer tube. A core is cut and disposed within the inner tube. Thereafter, hydraulic fluid is selectively diverted to a piston chamber included within the coring tool. The piston is then longitudinally displaced by means of the hydraulic force applied thereto by the hydraulic fluid diverted to the piston chamber. The inner tube is similarly longitudinally displaced as the piston is longitudinally displaced. The longitudinal displacement of the inner tube is then used as a motive force for activation of any downhole operation, such ss activating a core catcher to retain a core.

These and other features of the invention may be better understood by now turning to the following figures, wherein like elements are referenced by like numerals.

The present invention, including its mode and manner of operation, is better understood by considering the above figures in light of the following detailed description.

DETAILED DESCRIPTION OF THE PREFERRED EMBODIMENT

The invention is an improved externally powered mechanism for activating core catchers within coring tools or any other downhole tool. Activation of the mechanism, and indirectly of the core catcher, is externally precipitated and not dependent upon any type of coaction with the core, or dependent in any manner upon the action of gravity. One prior art method for externally powering a core catcher is shown and described in an application entitled, "Hydraulic Lift Inner Barrel In A Drill String Coring Tool," Ser. No. 530,492, filed Sept. 9, 1983, assigned to the same assignee as the present invention. While the apparatus and methodology disclosed within that application is highly satisfactory and represents a substantial improvement over the prior art, the design can be further improved, particularly with respect to its versatility, reliability, simplicity and economy of fabrication. The structure and method of operation of the improved mechanism can better be understood by now turning to consider in detail the illustrated embodiment.

Figure 1:
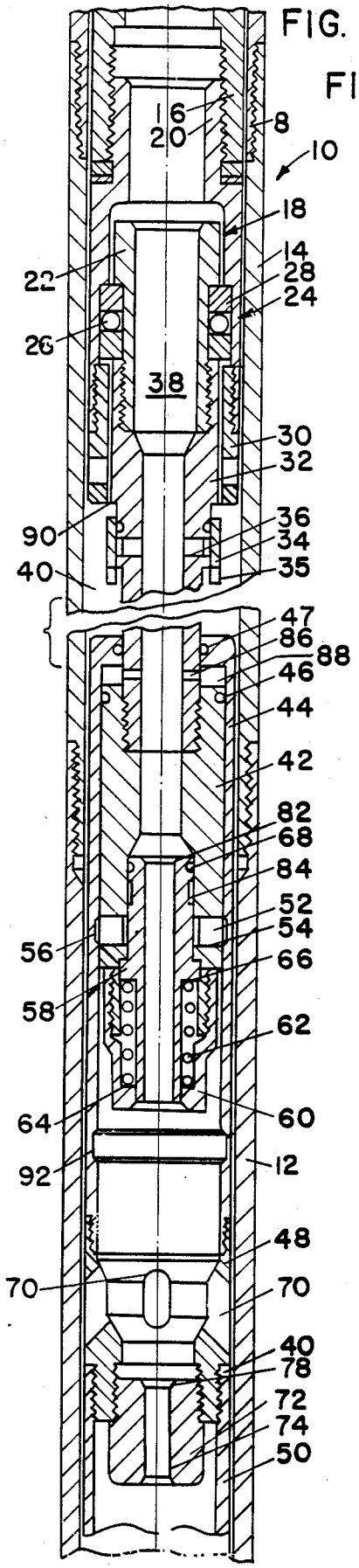
FIG. 1 is a longitudinal sectional view of a drill string used in a coring operation which incorporates the improved invention.

Turn first to FIG. 1, which is a broken cross-sectional view of a portion of a drill string, such as used in a coring operation, which drill string incorporates the improved invention. The drill string, generally denoted by reference numeral 10, includes an outer tube 12 threadedly coupled in a conventional manner to an outer tube sub 14. Although not shown in the figures, outer tube 12 longitudinally extends downwardly in the drill string and is ultimately coupled through additional subsections to a coring bit (not shown).

Beginning at the top of drill string 10, safety joint box 8 is conventionally coupled, by means not shown, to a safety joint pin 16. Safety joint pin 16 in turn is threadably coupled to a swivel assembly 18. Safety joint 16 and swivel assembly 18 are concentrically disposed within an interior bore defined by safety joint box 8 and outer tube sub 14. Swivel assembly 18 includes an upper member 20, which is threadably coupled at its upper end to safety joint pin 16, and which is rotatably coupled at its opposing lower end to a rotational member 22 by means of a conventional ball bearing assembly 24. Ball bearing assembly 24 includes a plurality of spherical bearings 26 captured within a cylindrical bearing raceway 28, which in turn is disposed within mating cylindrical indentations defined within upper member 20 on one hand, and rotational member 22 on the other. The lower portion of upper member 20 is also threadably coupled to a bearing retainer nut 30 while the lower portion of rotational member 22 is coupled to a pressure relief sub 32. Pressure relief sub 32 and retaining nut 30 retain bearing assembly 24 within swivel assembly 18. Therefore, as safety joint box 8, and outer tube sub 14, and outer tube 12 rotate during the drilling operation, safety joint pin 16 and upper member 20 will rotate with them. However, bearing assembly 24 allows pressure relief sub 32 to be rotationally fixed with respect to the rock formation (hence rotationally free from outer tube 12), and longitudinally fixed with respect to outer tube 12.

In the preferred embodiment sub 32 includes a pressure relief valve 34 axially disposed about and concentric with the upper portion of sub 32. Valve 34 is a cylindrical element slidingly disposed over sub 32, and covering and sealing bore 36 defined through sub 32. Valve 34 includes a plurality of depending fingers 35 longitudinally extending downwardly outside of sub 32 toward piston 44. As described below, piston 44 will ultimately abut finger 35 and force valve 34 upward, thereby uncovering bore 36 and allowing pressure within axial bore 38 to be vented into annular space 40.

One other embodiment would show a pressure relief sub 32 which could include one or more conventional bursting disks disposed in corresponding radial bore 36. Normally, each bursting disk would seal its corresponding bore 36, thereby preventing the flow of any drilling mud or hydraulic fluid within axial bore 38 from escaping and flowing into annular space 40 between the exterior of pressure relief sub 32 and the interior of outer tube sub 14.

Pressure relief sub 32 continues longitudinally downward within drill string 10, and is threadably coupled to an inner mandrel 42. Inner mandrel 42 is also concentrically disposed within outer tube sub 14 and outer tube 12, and is furthermore telescopically and slidingly disposed within outer piston 44. Pressure relief sub 32 and outer piston 44 are maintained in a hydraulically sealed relationship with respect to each other by virtue of a circumferential conventional O-ring 47. Outer piston 44 in turn is disposed concentrically within outer tube sub 14 and outer tube 12 and outside of inner mandrel 42. Similarly, inner mandrel 42 and outer piston 44 are maintained in a hydraulically sealed relationship with respect to each other by virtue of a circumferential conventional O-ring 46. Outer piston 44 longitudinally extends downwardly within drill string 10, past the end of inner mandrel 42, and is threadably coupled to an inner tube adapter 48. Inner tube adapter 48 in turn is threadably coupled to a conventional inner tube 50. The core is cut by the coring bit and disposed within inner tube 50. Thus, the entire interior structure of drill string 10 from pressure relief sub 32 to inner tube 50 is concentrically disposed within outer tube 12 and outer tube sub 14, and is rotationally fixed with respect to the rock formation, and rotationally free from outer tube 12.

Outer piston 44 is initially longitudinally temporarily fixed with respect to inner mandrel 42 by means of one or more locking dogs 52. Locking dogs 52 are disposed in radial bores 54 defined in inner mandrel 42, and extend into a corresponding and mating indentation groove 56 defined in the interior surface of outer piston 44. Locking dogs 52 are retained in the locked position of FIG. 1, wherein outer piston 44 is locked by means of an inner piston 58. Inner piston 58 is telescopically and slidingly disposed within an axial bore defined through inner mandrel 42, and retained therein by means of a spring loaded coupling with a piston retaining nut 60. Piston retaining nut 60 in turn is threadably coupled to the lower end of inner mandrel 42. Inner piston 58 is retained within piston retaining nut 60, and thus inner mandrel 42, by means of a coil compression spring 62 circumferentially disposed outside of the lower end of inner piston 58, and extending from an interior lower shoulder 64 of piston retaining nut 60 to an upper outer shoulder 66 of inner piston 58. Inner piston 58 is hydraulically sealed with respect to inner mandrel 42 by means of a conventional circumferential O-ring 68.

Therefore, the space defined by axial bore 38 extends from the interior of drill string 10 above safety joint pin 16 longitudinally throughout the portion of drill string 10 shown in FIG. 1, through inner mandrel 42, through inner piston 58 and downwardly through inner tube adapter 48 into the interior of inner tube 50. Inner tube adapter 48 is provided with a plurality of radial bores 70 which allow free hydraulic communication between axial space 38 and annular space 40. The lower end of inner tube adapter 48 is threadably coupled to a pressure relief plug 72. The pressure relief plug 72 defines an axial bore 74 to permit longitudinal hydraulic communication throughout the entire length of axial space 38 into inner tube 50.

Figure 2:
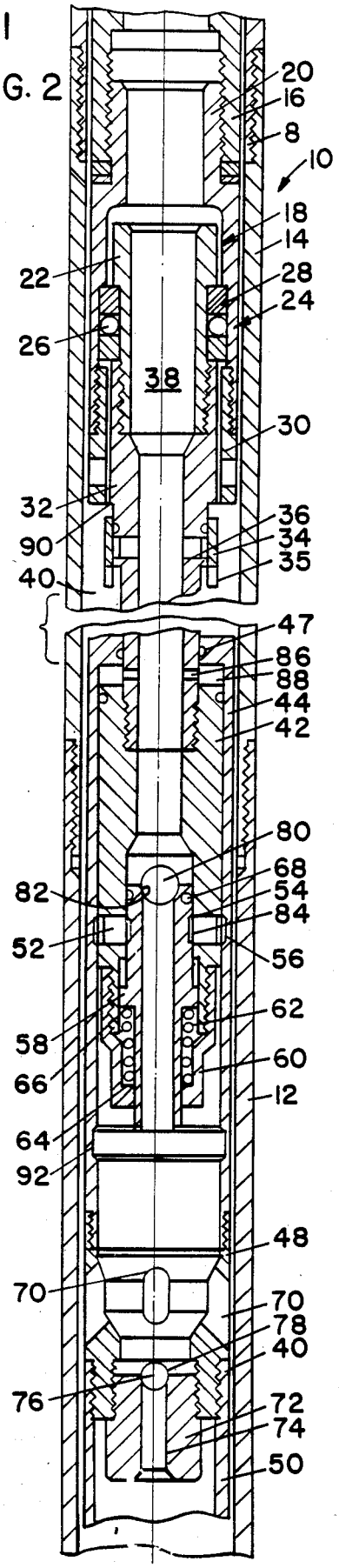
FIG. 2 is a cross-sectional view of the drill string of FIG. 1 at a first stage of operation.

Turn now to the illustration of FIG. 2, which is a cross-sectional view of the drill string 10 of FIG. 1 after the tool has been activated. As shown in FIG. 1, continuous fluidic communication throughout drill string 10 is provided through axial space 38. This allows the interior of inner tube 50 to be washed or flushed clean according to conventional well coring practices. However, when the coring operation is to being, the well operator drops a first steel ball 76 into the drill string. Ultimately steel ball 76 will come to rest against seat 78 defined on the upper interior end of pressure relief plug 72. Fluidic communication with the interior of inner tube 50 will now be prohibited. The hydraulic fluid being pumped from the well surface into the interior of drill string 10 will continue through axial space 38, but will be diverted within inner tube adapter 48 through ports 70 into annular space 40 between inner tube 40 and outer tube 12.

When the coring operation has been completed, and it is desired to break and retrieve the core from the rock formation, a second ball 80 is dropped into axial space 38 from the well platform. Again, second ball 80 will ultimately come to rest against a seat 82 defined in the upper end of inner piston 58. The further escape of hydraulic fluid from axial space 38 into annular space 40 is now temporarily prohibited. Pressure will now begin to rise within axial space 38. As the pressure increases, piston 58 and ball 80 begin to be forced downwardly against the resilient force of spring 62. As spring 62 compresses, outer circumferential indentation groove 84 defined in the outer surface of inner piston 58 will utlimately become aligned with dog 52. Meanwhile, the increased pressure within axial space 38 will be communicated by virtue of a plurality of radial bores 86 defined through pressure relief sub 32 which bores 86 communicate with an interior expansion space 88 of outer piston 44. This will exert a pressure within space 88 tending to longitudinally force outer piston 44 upwardly. However, outer piston 44 will remain locked in position by dog 52 until such time as inner piston 58 has been downwardly longitudinally compressed to align indentation 84 with dog 52. At this point dog 52 will snap into indentation 84, being urged therein by the upward force exerted upon outer piston 44.

Outer piston 44 will now be unlocked and free to be longitudinally displaced upwardly within drill string 10. As outer piston 44 is longitudinally forced upwardly by the injection of pressurized hydraulic fluid into space 88, inner tube 50, which is threadably coupled through inner tube adapter 48 to outer piston 44, will similarly be drawn upwardly.

This upward movement of inner tube 50 can then be used to activate other downhole tools, such as core catchers.

Figure 3:
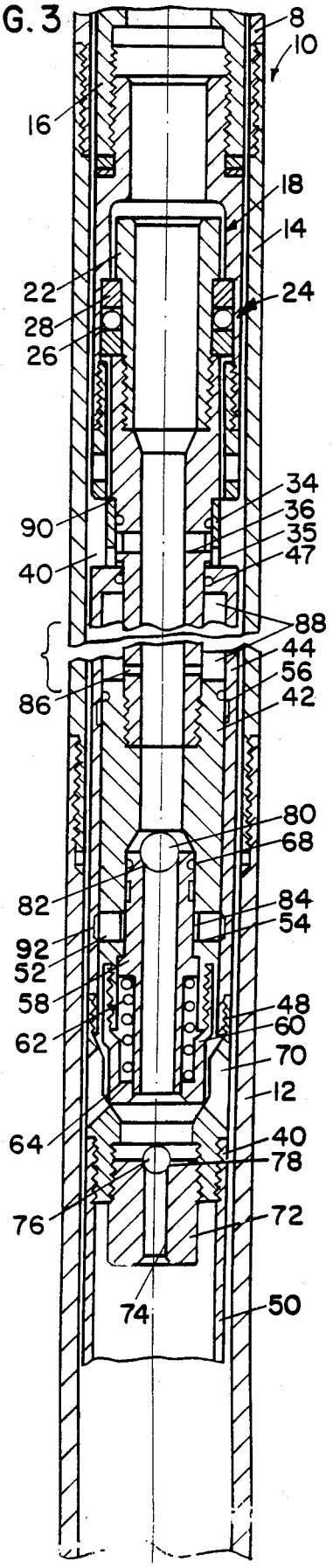
FIG. 3 is a cross-sectional view of the drill string of FIGS. 1 and 2 at a second stage of operation.

Turn now to FIG. 3, wherein piston 44 is shown in the upwardly locked piston. The expansion of outer piston 44 is limited by the abutment of the top of piston 44 with fingers 35 and the longitudinal upward disposition of valve 34 until it in turn abuts shoulder 90. At this point bore 36 is uncovered and the pressure within axial bore 38 equalizes with that in annular space 40. At this point the core catcher activation will have been completed, and hydraulic flow restored outside of inner tube 50.

In the illustrated embodiment a fully expanded locked position is shown and is achieved by defining an interior indentation 92 within outer piston 44 similar to that defined by interior indentation 56, but longitudinally disposed below indentation 56 by a predetermined distance. Lower indentation 92 will move upwardly to become at least even with dogs 52 during the expansion of outer piston 44. After valve 34 has been activated, the hydraulic pressure within axial space 38 will decrease and compression spring 68 will tend to urge inner piston 58 upwardly and force locking dogs 52 radially outward. As piston 44 falls, realigning the locking indentation 92 with dogs 52, dogs 52 are forced into the locking indentation 92, thereby longitudinally fixing outer piston 44 with respect to outer tube 12, and allowing inner piston 58 to fully expand under the force of compression spring 62.

Many modifications and alterations may be made by those having ordinary skill in the art without departing from the spirit and scope of the invention. Therefore, the illustrated embodiment must be understood as being described only for the purposes of clarity in example. It is not intended in the illustrated embodiment to serve as a limitation of the invention, which is defined in the following claims.

We claim:

1. An apparatus for hydraulically lifting an inner tube concentrically disposed within an outer tube in a drill string comprising:

first port means for selectively diverting fluid within said outer tube;

piston means for providing longitudinal displacement of said inner tube in response to selectively diverted drilling fluid, said first port means selectively diverting drilling fluid to said piston means, and said piston means being coupled to said inner tube, said piston means for further longitudinally displacing said inner tube in response to drilling fluid diverted thereto by said first port means;

lock means for selectively locking said piston means in a fixed position with respect to said outer tube, said lock means also being selectively provided with drilling fluid by said first port means, said lock means also for selectively unlocking said piston means after a first predetermined magnitude of hydraulic pressure of said fluid has been supplied to said piston and lock means, said piston means then longitudinally displacing said inner tube with respect to said outer tube by a predetermined distance, said first port means then selectively redivverting said drilling fluid away from said piston and lock means when said piston means has moved a predetermined longitudinal distance; and second port means for selectively providing drilling fluid to flush said inner tube prior to commencement of activation of said first port, piston and lock means, and for selectively diverting drilling fluid from the interior of said inner tube prior to activation of said first port, piston and lock means, whereby said inner and outer tubes may be selectively longitudinally displaced wtih respect to each other in an automatic fashion by activation of said first port means and whereby said inner tube may be selectively flushed by said drilling fluid prior to activation of said first port means.

2. The apparatus of claim 1 wherein said first port means comprises a bearing assembly disposed within said outer tube and connected to said lock means, and further includes a selectively closable hydraulic port defined within said bearing assembly.

3. The apparatus of claim 2 wherein said first port means further comprises a selectively openable hydraulic port defined in said bearing assembly to selectively divert said drilling fluid from said piston and lock means when said port is selectively opened.

4. The apparatus of claim 2 wherein said piston means is a piston longitudinally disposed within said outer tube, and longitudinally displaceable with respect to said bearing assembly, said inner tube being connected to said piston.

5. The apparatus of claim 4 wherein said lock means for selectively locking said piston means with respect to said outer tube comprises a resiliently biased inner locking piston longitudinally displaceable by said drilling fluid, said lock means also comprising locking dog means responsive to said inner locking piston wherein a predetermined longitudinal displacement of said inner locking piston responsive to said hydraulic fluid activates said locking dog means to unlock said piston means from its fixed position with respect to said outer tube.

6. A hydraulic lift apparatus for use in combination with a drill string and a coring bit used for coring, said drill string being characterized by including an outer tube connected to a coring bit and having pressurized hydraulic fluid forced through said outer tube, said drill string further characterized by an inner tube for receiving and lifting a core cut by said core bit, said drilling fluid generally flowing between said outer and inner tube to said core bit, said hydraulic lift apparatus comprising:

an inner mandrel longitudinally fixed and coupled to said outer tube and concentrically disposed within said outer tube, said inner mandrel defining an axial bore in communication with the interior of said drill string and having said drilling fluid supplied therethrough;

an outer piston disposed within said outer tube and concentrically disposed in telescopic relationship about said inner mandrel, said outer piston being selectively longitudinally fixed with respect to said inner mandrel and hence said outer tube, said outer piston being connected to said inner tube, said outer piston defining an expansion chamber in communication with said axial bore defined within said inner mandrel;

first means for selectively providing drilling fluid and pressure to said expansion chamber of said outer piston, and for selectively unlocking said outer piston with respect to said inner mandrel to thereby selectively longitudinally displace said outer piston with respect to said inner mandrel, and thence to lift said inner tube; and second means for providing drilling fluid to the interior of said inner tube to flush said inner tube before said coring begins, said second means for providing drilling fluid to said inner tube communicated with said axial bore of said inner mandrel so that drilling fluid flowing therethrough is selectively diverted from the interior of said inner tube, whereby said hydraulic lift apparatus is included within said drill string for selectively lifting said inner tube within said drill string to facilitate downhole operation of said apparatus and whereby hydraulic fluid is flushed through said inner tube prior to said coring.

7. The hydraulic lift apparatus of claim 6 wherein said inner mandrel is coupled to said outer tube and longitudinally fixed thereto to a bearing assembly, said bearing assembly having a first portion connected to said outer tube and a second portion rotatable with respect to said first portion, said second portion of said bearing assembly being connected with said inner mandrel whereby said inner mandrel is rotatable with respect to said outer tube while being longitudinally fixed with respect thereto.

8. The hydraulic lift apparatus of claim 6 wherein said first means for providing drilling fluid and pressure, and for selectively unlocking said outer piston with respect to said inner mandrel comprises third means for selectively diverting drilling fluid and pressure to said expansion chamber inside said outer piston, and an inner locking piston disposed within said inner mandrel and responsive to said drilling fluid and pressure applied thereto to selectively unlock said inner mandrel from said outer piston, said outer piston then being responsive to drilling fluid and pressure supplied to said expansion chamber within said outer piston to be longitudinally displaced with respect to said inner mandrel, thereby lifting said inner tube connected to said outer piston upwardly within said outer tube.

9. The hydraulic lift apparatus of claim 8 wherein said inner locking piston is longitudinally displaced within said inner mandrel within an axial bore defined therein, said inner locking piston resiliently biased to assume a first position and responsive to said drilling fluid and pressure to assume a second postion, said inner locking piston further comprising a locking dog slidingly disposed in a radial bore defined through said inner mandrel, said locking dog engaging said outer piston when said inner locking piston is in said first position to longitudinally fix said outer piston to said inner mandrel, said locking dog disengaging said outer piston when said inner locking piston assumes said second position, said locking dog being received within a mating indentation defined within said inner locking piston when said inner locking piston is in said second position, thereby allowing said disengagement of said locking dog from said outer piston and permitting said outer piston to become longitudinally displaced in response to drilling fluid and pressure provided inside said expansion chamber of said outer piston.

10. The hydraulic lift apparatus of claim 9 further comprising fourth means for removing drilling fluid and pressure from said axial bore of said inner mandrel and from inside said expansion chamber of said outer piston after said outer piston has been longitudinally displaced by a predetermined distance.

11. The hydraulic lift apparatus of claim 10:

wherein said first means for providing drilling fluid and pressure to said inner mandrel and inside said expansion chamber of said outer piston comprises at least one passage communicating hydraulic fluid flowing through said axial bore of said inner mandrel with said expansion chamber of said outer piston; and wherein said third means for selectively diverting hydraulic fluid and pressure to said inner mandrel and inside said expansion chamber of said outer piston comprises a selectively closeable port through which said drilling fluid primarily flows during normal operation into said inner tube, said port being selectively closeable to divert all drilling fluid and pressure to said passage communicating said axial bore in said inner mandrel with said expansion chamber of said outer piston.

12. The hydraulic lift apparatus of claim 11 wherein said fourth means for removing drilling fluid and hydraulic pressure from said inner mandrel and from inside said expansion chamber of said outer piston comprises at least one passage communicating said axial bore in said inner mandrel to the interior of said outer tube of said drill string and a valve for selectively sealing said passage, said passage being closed by said valve until a predetermined longitudinal displacement of said valve is effected, said valve being actuated by said outer piston to unseal said passage after said predetermined longitudinal displacement of said outer piston.

13. An improvement in a hydraulic lift apparatus in a coring tool, said coring tool including an outer tube and an inner tube for receiving a core cut by said coring tool, drilling fluid being supplied under pressure to the interior of said coring tool, said improvement comprising;

an axial bore defined through said coring tool and communicating with the interior of said inner tube to flush said inner tube;

means communicating with said axial bore for selectively preventing the communication of said drilling fluid with said inner tube, and for selectively diverting said drilling fluid to an annular space defined between the outside of said inner tube and the insider of said outer tube; and means for selectively drawing said inner tube longitudinally upward within said coring tool, wherein said means for selectively preventing hydraulic fluid from communicating with the interior of said inner tube and for diverting drilling fluid to said annular space comprises:

a pressure relief plug having an axial bore defined therethrough, said axial bore of said pressure relief plug communicating said axial bore of said coring tool to the interior of said inner tube; and ball valve means selectively disposable in said pressure relief plug for closing said axial bore of said pressure relief plug and for preventing communication of said drilling fluid from said axial bore of said coring tool to the interior of said inner tube, whereby said coring tool may be used to flush the interior of said inner tube prior to initiation of a coring operation and thereafter provide a positive, actuating, longitudinally upward force at a selected time during the coring operation.

14. The improvement of claim 13 further comprising a plurality of radial ports communicating said axial bore of said coring tool to said annular space between said inner tube and outer tube, said plurality of radial ports disposed within said coring tool upstream of said pressure relief plug so that when said pressure relief plug is selectively closed by said ball valve means, drilling fluid flowing through said axial bore of said coring tool flows through said radial ports into said annular space between said inner tube and outer tube.

15. An improvement in a hydraulic lift apparatus in a coring tool, said coring tool including an outer tube and an inner tube for receiving a core cut by said coring tool, drilling fluid being supplied under pressure to the interior of said coring tool, said improvement comprising;

an axial bore defined through said coring tool and communicating with the interior of said inner tube to flush said inner tube;

means communicating with said axial bore for selectively preventing the communication of said drilling fluid with said inner tube, and for selectively diverting said drilling fluid to an annular space defined between the outside of said inner tube and the insider of said outer tube; and means for selectively drawing said inner tube longitudinally upward within said coring tool, wherein said means for selectively drawing said inner tube longitudinally upward within said coring tool comprises:

a bearing assembly concentrically disposed within said outer tube and having an upper end fixed with respect to said outer tube and having a lower end rotationally free with respect to said outer tube, said axial bore of said corng tool extending through said bearing assembly;

an inner mandrel coupled to said bearing assembly, said axial bore or said coring tool extending through said inner mandrel;

an outer piston telescopically disposed outside said inner mandrel and longitudinally displaceable with respect to said inner mandrel, said outer piston defining an expansion chamber between the interior of said outer piston and said inner mandrel, said expansion chamber being in communication with said axial bore of said coring tool; and an inner piston means for selectively locking said outer piston in fixed longitudinal relationship with said inner mandrel, said axial bore of said coring tool extending through said inner piston means, said inner piston means further for selectively closing said axial bore of said coring tool and for selectively diverting drilling fluid into said expansion chamber defined by said outer piston, whereby said coring tool may be used to flush the interior of said inner tube prior to initiation of a coring operation and thereafter provide a positive, actuating, longitudinally upward force at a selected time during the coring operation.

16. A method of providing drilling fluid flow through a coring tool comprising the steps of:

providing flow of drilling fluid under pressure from the interior of an outer tube within a drill string, longitudinally downward through an axial bore defined within said coring tool into the interior of an inner tube to flush said inner tube;

selectively interrupting flow of said drilling fluid into the interior of said inner tube;

diverting hydraulic fluid into an annular space defined between the outside of said inner tube and the inside of said outer tube;

cutting a core and disposing said core in said inner tube;

selectively diverting drilling fluid to a piston chamber included within said coring tool;

longitudinally displacing a piston with hydraulic force in response to said drilling fluid diverted to said piston chamber; and longitudinally displacing said inner tube with longitudinal displacement of said piston.

17. The method of claim 16 further comprising the step of simultaneously providing drilling fluid to said annular space between said inner and outer tubes simultaneously with the step of providing said drilling fluid to the interior of said inner tube.

18. The method of claim 17 further comprising the step of interrupting the flow of said drilling fluid to said annular space between said inner and outer tubes when said drilling fluid is selectively diverted to said piston chamber.

19. The method of claim 16 further comprising the step of interrupting the flow of said drilling fluid to said annular space between said inner and outer tubes when said drilling fluid is selectively diverted to said piston chamber.

* * * * *